US009688470B2

(12) United States Patent
Kirby

(10) Patent No.: US 9,688,470 B2
(45) Date of Patent: Jun. 27, 2017

(54) REFUSE CONTAINER COVER

(71) Applicant: Kerry J Kirby, Toronto (CA)

(72) Inventor: Kerry J Kirby, Toronto (CA)

( * ) Notice: Subject to any disclaimer, the term of this patent is extended or adjusted under 35 U.S.C. 154(b) by 307 days.

(21) Appl. No.: 14/517,335

(22) Filed: Oct. 17, 2014

(65) Prior Publication Data

US 2016/0107836 A1 Apr. 21, 2016

(51) Int. Cl.
*B65D 65/02* (2006.01)
*B65F 1/14* (2006.01)

(52) U.S. Cl.
CPC ..... *B65F 1/14* (2013.01)

(58) Field of Classification Search
CPC ..... B65D 81/3886; B65D 25/34; A61G 5/10; B62D 1/06; E04G 21/30
USPC ..... 150/154–167; 206/315.4; 220/287, 315
See application file for complete search history.

(56) References Cited

U.S. PATENT DOCUMENTS 4,811,767 A * 3/1989 Kessler ..... E04H 1/1238 150/154
6,062,412 A * 5/2000 Jacobsmeyer, Jr. ..... B65F 1/16 150/154
6,725,893 B1 * 4/2004 Erickson ..... A61B 46/10 150/154
8,997,769 B2 * 4/2015 Carpenter ..... F02B 63/048 135/161
9,241,585 B2 * 1/2016 Marks ..... A47G 7/085
2003/0010415 A1 * 1/2003 Szuszkiewicz ..... B65D 65/02 150/154
2003/0219567 A1 * 11/2003 Weder ..... A01G 5/04 428/131
2006/0086444 A1 * 4/2006 Yu ..... A45C 13/002 150/154
2010/0095587 A1 * 4/2010 Marks ..... A47G 7/085 47/72

* cited by examiner

*Primary Examiner* — Fenn Mathew
*Assistant Examiner* — Cynthia Collado
(74) *Attorney, Agent, or Firm* — Elias C. Borges

(57) ABSTRACT

A garbage bin cover is disclosed. The cover includes a flexible fabric tube having opposite open top and bottom ends and a middle portion which are dimensioned to fit snuggly over a garbage bin. A pair of elongated zippers is provided on opposite sides of the cover, the zippers extend parallel to each other upwardly from the bottom end such that the zippers open from the bottom end. An elongated pouch containing a drawstring is formed at the upper end of the tube. A separate lid cover is provided with consists of a pouch dimensioned to fit snugly over a garbage bin lid.

3 Claims, 5 Drawing Sheets

REFUSE CONTAINER COVER

CROSS REFERENCE TO RELATED APPLICATION

This application claims priority form U.S. Provisional Application Ser. No. 61/892,653 filed Oct. 18, 2013, the entirety of which is incorporated herein by reference.

FIELD OF THE INVENTION

The invention relates generally to removable covers for wheeled refuse containers or bins.

BACKGROUND OF THE INVENTION

Household garbage and refuse is generally stored in refuse containers (often called "garbage cans") for pick up by municipal authorities. In most modern municipalities, garbage cans now take the form of large rectangular plastic bins having a body, an open top, a closed bottom, a lid hinged to the open top and a pair of wheels mounted to the body adjacent the closed bottom. The body tends to taper from the open top to the closed bottom because the outside diameter of the open top is usually greater than the outside diameter of the closed bottom. The bottom usually has a pair of wheel wells for allowing a pair of wheels to be mounted therein. The wheels make the bin easier to carry.

While household garbage bins are convenient and easy to use, they tend to be quite large and unsightly. Furthermore, since they are garbage bins, they tend to get soiled with garbage, often making them unattractive. Since they are generally placed in front of a residence, they tend to distract from the visual appeal of the residential property they sit in front. A means of making the bins more attractive is therefore desirable.

SUMMARY OF THE INVENTION

In accordance with one aspect of the present invention, there is provided a cover for a wheeled refuse container. The refuse container has an open top and a closed bottom, the open top having a outside diameter greater than an outside diameter of the bottom. A body extends between the open top and the bottom, the body having an external diameter which tapers from the open top to the bottom. A pair of wheel wells is formed at the bottom and a lid is hinged at the open top. The cover includes a tube made of a flexible web material, the tube having opposite open first and second ends and a middle portion extending between the first and second ends. The first end has an internal diameter slightly greater than the external diameter of the open top. The second end has an internal diameter slightly greater than the outside diameter of the bottom and the middle portion has an internal diameter which tapers in conformity to the tapering of the outside diameter of the body. The middle portion has a front portion, a back portion and opposite first and second side portions. The cover also has first and second zippers formed on the first and second sides of the middle portion, respectively, each zipper extending part way up the middle portion towards the first end from the second end such that the zippers open at the second end. The first and second zippers are parallel to each other. The cover also has an elongated drawstring positioned in an elongated pouch formed on the first end of the tube, the elongated pouch extending along the first end adjacent the front portion and the opposite first and second side portions. The elongated pouch has opposite first and second openings for the drawstring, the first opening formed at a first top corner of the middle portion where the back portion meets the first side portion and the second opening formed at a second top corner where the back portion meets the second side portion.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 2:
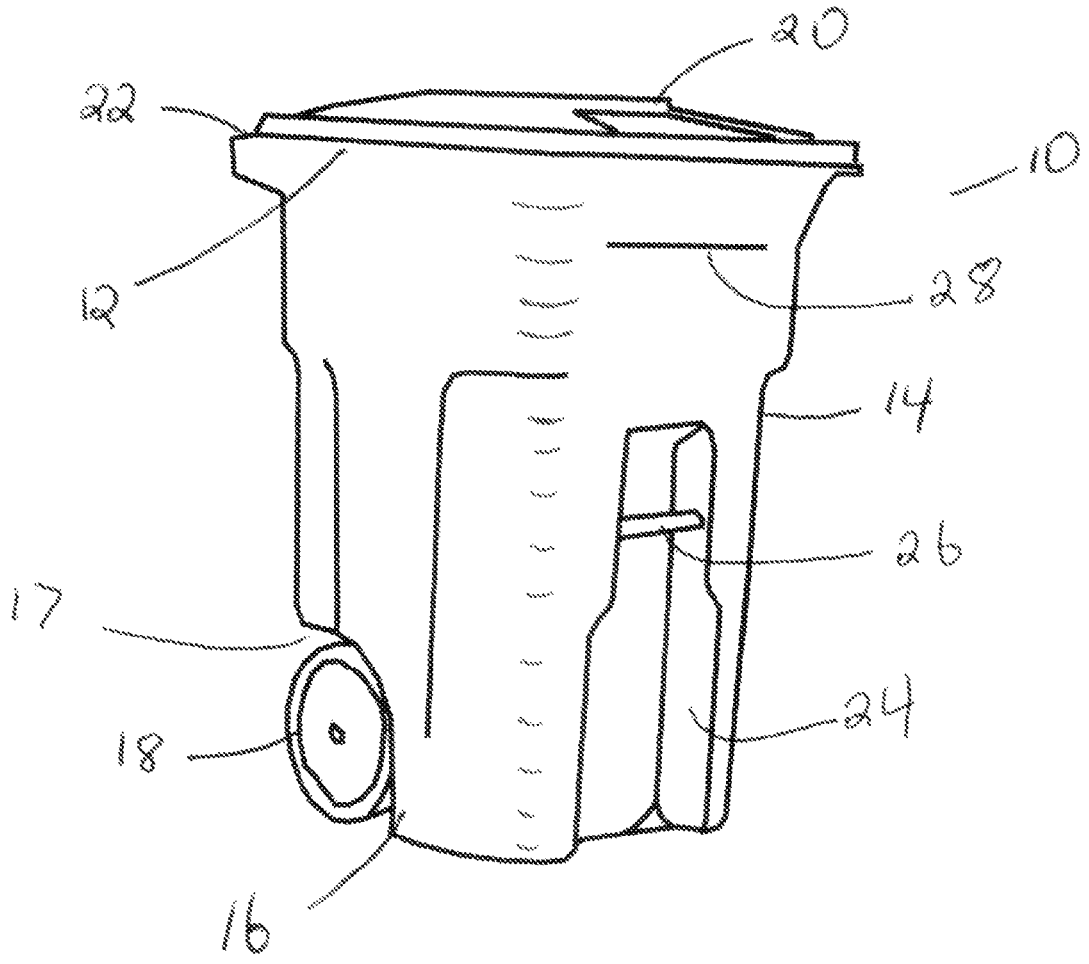
FIG. 2 is a perspective view of a garbage bin which is used with the garbage bin cover of the present invention.

Referring to FIG. 2, a garbage bin which is to be covered by the present invention is shown generally as item 10 and includes an open top 12, a body 14 and a closed bottom 16. Wheel wells 17 are formed on the back side of bottom 16 to permit wheels 18 to be mounted to bottom 16. Open top 12 is generally covered by a lid 20 which is attached at the back of top 12 by hinge 22. A front vestibule 24 is usually provided on the body at the front of the bin and a support arm 26 is usually mounted at an upper end of the vestibule. Vestibule 24 and support arm 26 are generally provided to allow some garbage bin collecting machines to grasp the garbage bin. An additional lip (or ridge) 28 may be provided at the front side of body 14 to aid in grasping the bin by certain types of automatic bin grasping devices.

Figure 1:
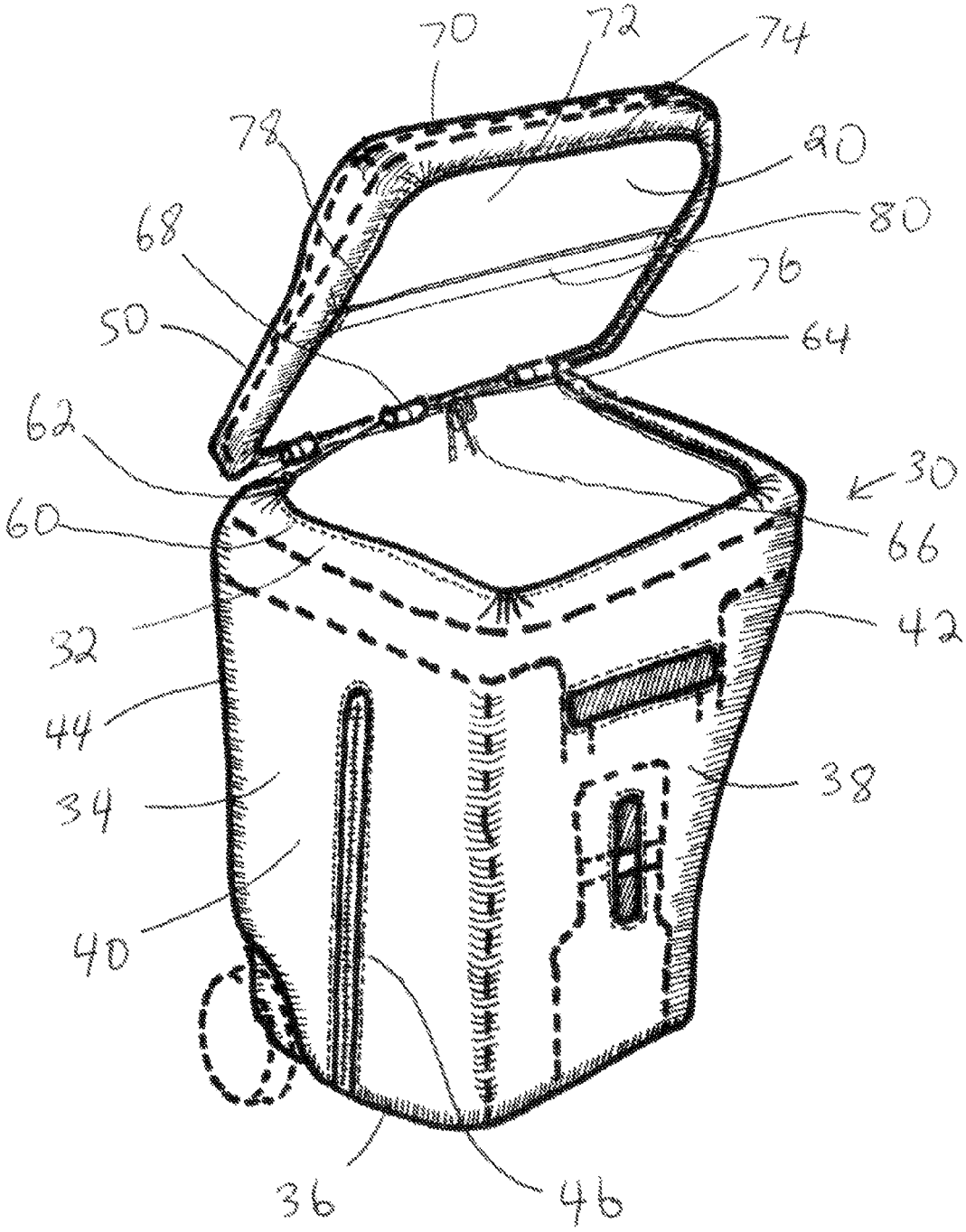
FIG. 1 is a perspective view of a garbage bin cover made in accordance with the present invention.
Figure 4:
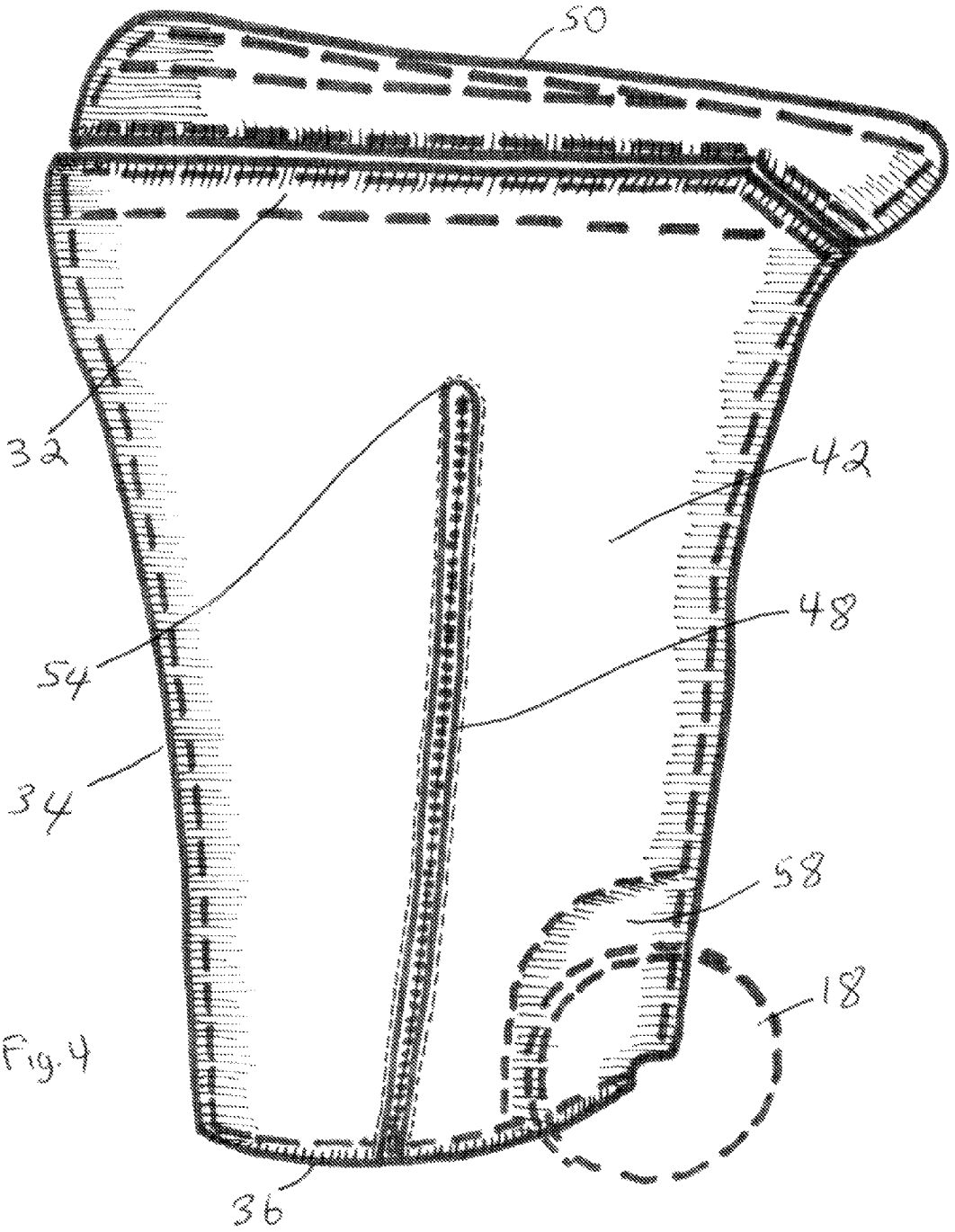
FIG. 4 is a left side view of the garbage bin cover shown in FIG. 1.

Referring now to FIG. 1, cover 30 consists of a large tube of flexible web material which is dimensioned to fit snuggly over bin 10 (shown in dotted lines). Cover 30 may be made of any durable yet flexible fabric material, either woven or unwoven. Canvas, unwoven polyethylene, polyester or other tough durable fabrics suitable for use in constructing cover 30 are readily available in the market. Cover 30 has open first end 32, open bottom end 36 and middle portion 34. First end 32 has an inside diameter slightly greater than the outside diameter of open top 12 (see FIG. 2). Likewise, second end 36 has an inside diameter slightly greater than the outside diameter of bottom 16 of the garbage bin (see FIG. 2). Middle portion 34 tapers in diameter from first end 32 to bottom end 36 in close conformity to body 14 of bin 10 (see FIG. 2). Middle portion 34 has a front portion 38, a back portion 44 and opposite side portions 40 and 42. Elongated zippers are formed on the side portions. FIG. 1 shows elongated zipper 46, and there is another elongated zipper 48 (see FIG. 4) on side 42.

Figure 3:
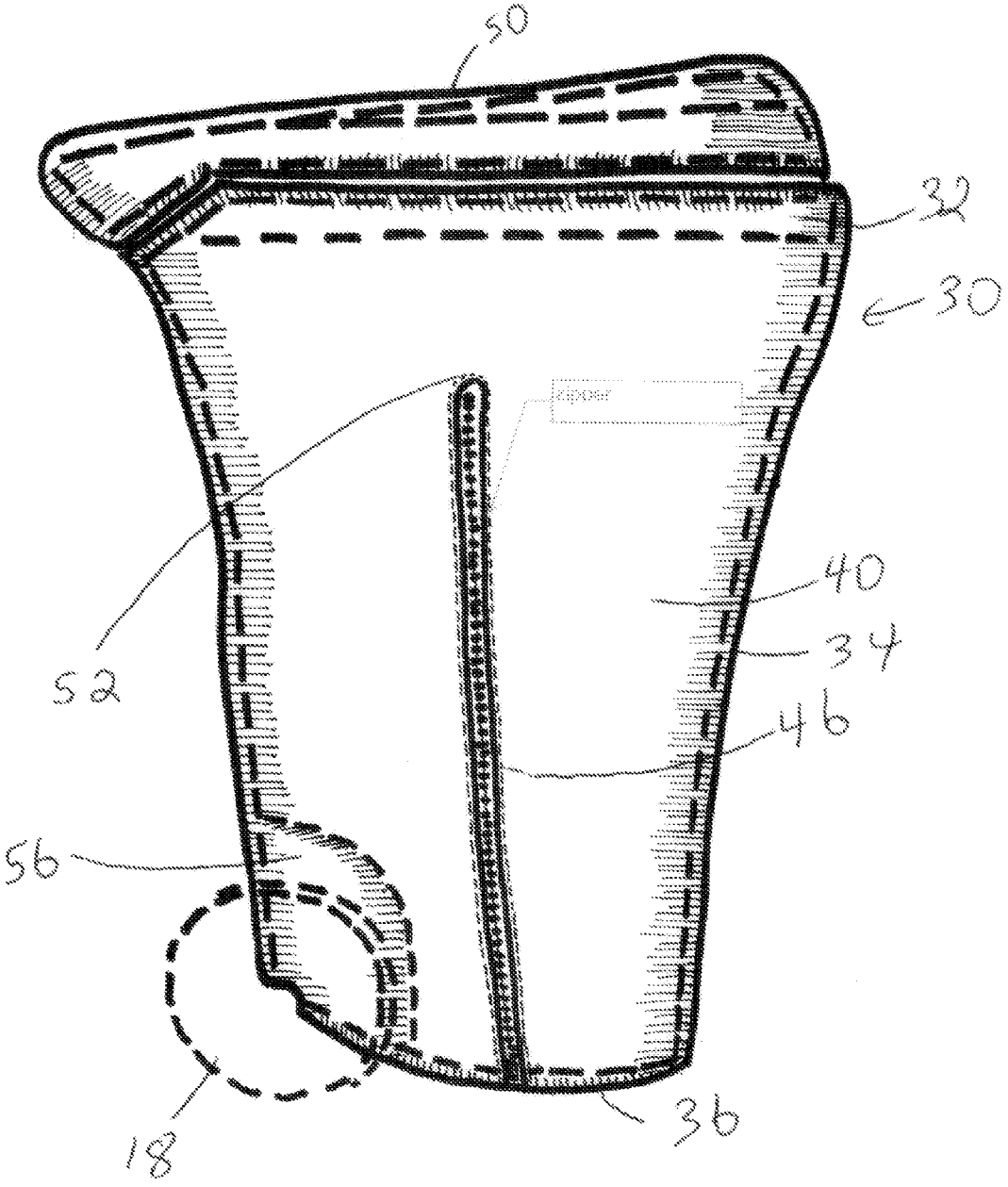
FIG. 3 is a right side view of the garbage bin cover shown in FIG. 1.

Referring now to FIG. 3, zipper 46 extends on side 40 from second end 36 to a point 52 below first end 32 such that the zipper opens at second end 36. Likewise, as seen in FIG.

4, zipper 48 extends on side 42 from second end 36 to a point 54 below first end 32 such that the zipper opens at second end 36. When the zippers are opened, the effective internal diameter of bottom end 36 and middle portion 34 is greatly increased, making it very easy to slip cover 30 over the garbage bin. After the cover is placed over the bin, zipping up the zippers will cause the diameter of middle portion 34 and bottom 36 to decrease, thereby permitting the cover to fit snugly over the bin. Portion 56 (FIG. 3) and portion 58 (FIG. 4) can be tucked behind wheels 18 to ensure proper operation of the wheels.

Referring back to FIG. 1, an elongated pouch 60 is formed on first end 32 for retaining a drawstring 66. Elongated pouch 60 is preferably formed by simply folding over the edge of end 32 and sewing (or bonding) to form the elongated pouch. Elongated pouch 60 has opposite openings 62 and 64. Opening 62 is formed on end 32 at the junction of back 44 and side 40. Likewise, opening 64 is formed on the end 32 at the junction of back 44 and side 42. This placement of the openings adjacent the back of the cover ensures that when drawstring 66 is pulled tight, end 32 is drawn tight together and cinches along front 32 and sides 40 and 42, but not along back 44. This prevents the cover from interfering with the operation of hinge elements 65 linking the lid to the body of the garbage bin.

Lid cover 70 is provided to cover lid 20 of the garbage bin. Cover 70 consists of a pouch made from a flexible fabric material, much like cover 30. Cover 70 has a large opening 72 with a lip having front portion 74 and opposite side portions 76 and 78. Cover 70 and opening 72 are dimensioned such that cover 70 fits snugly over lid 20. An elastic band 80 is mounted between opposite side portions 76 and 78 so that when the cover is fitted over lid 20, the elastic band keeps cover 70 tight onto the lid.

Figure 5:
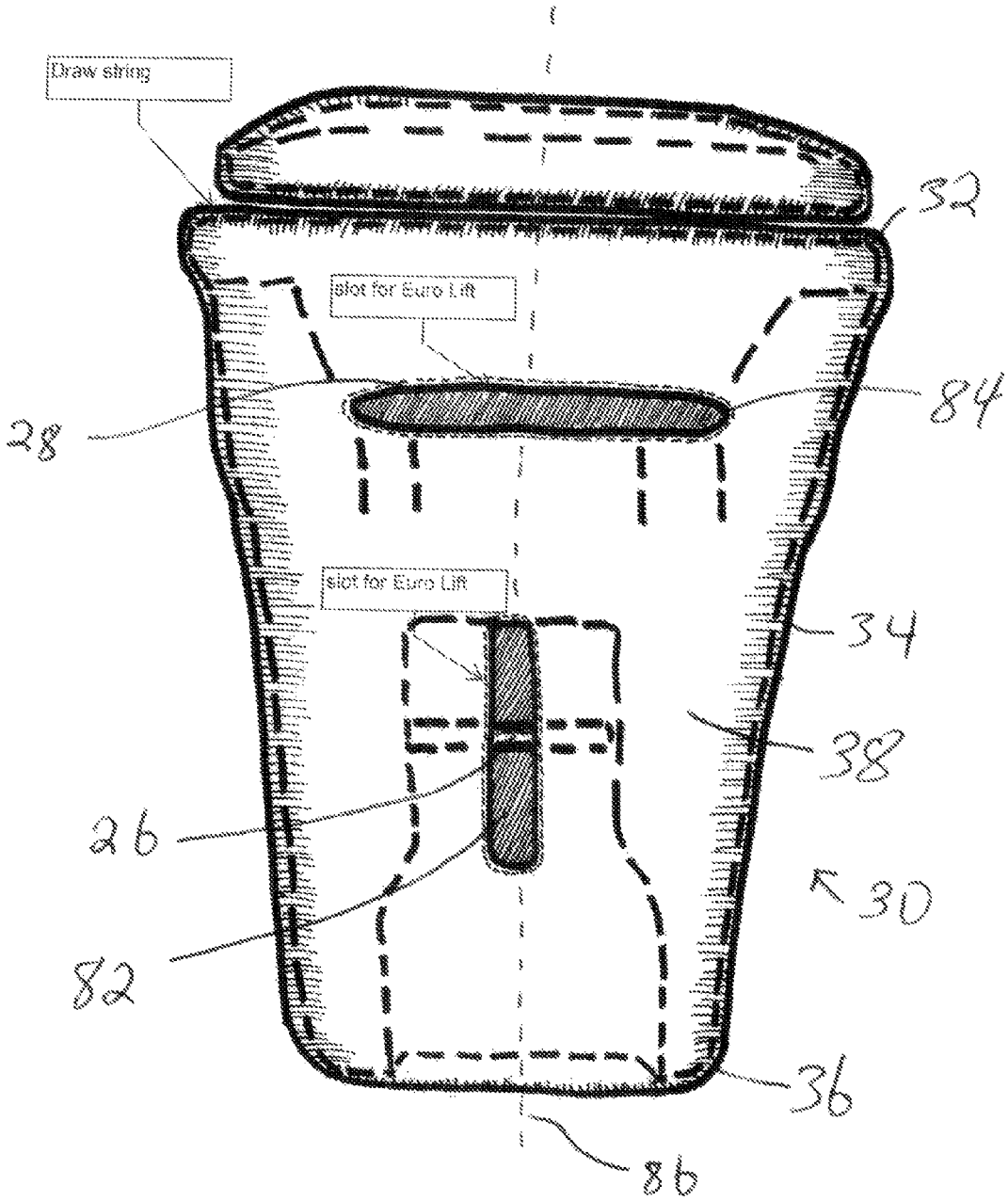
FIG. 5 is a front view of the garbage bin cover shown in FIG. 1.

Referring now to FIG. 5, front portion 38 of cover 30 may be provided with an elongated slot 82 which extends vertically along an axis 86 midway on front portion 38. The slot extends from a point above second end 36 and below first end 32 so that the slot exposes support bar 26. A horizontal slot 84 is positioned horizontally across front portion 38 between the side portions and between slot 82 and first end 32 so that rim 28 is exposed. Slots 82 and 84 are provided to enable "Euro Lift" type of bin graspers to be used without damaging the bin cover.

Cover 30 allows an unattractive garbage bin to be covered with an attractive pattern. The fabric forming cover 30 may have various printed patterns applied thereto so that the garbage bin, when covered, will look attractive. For example, cover 30 may have a pattern of leaves applied thereto so that when the covered bin is placed in front of the house, the cover causes the bin to look consistent with the other foliage or greenery in front of the house. Alternatively, festive patterns, such as a festive Christmas or Halloween pattern, may be applied to the cover, allowing for a more decorative appearance.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A cover for a wheeled refuse container having an open top and a bottom, the open top having a outside diameter greater than an outside diameter of the bottom, a body extending between the open top and the bottom, the body having an external diameter which tapers from the open top to the bottom, a pair of wheel wells formed at the bottom, and a lid hinged at the open top, the cover comprising:

a. A tube made of a flexible web material, the tube having opposite open first and second ends and a middle portion extending between the first and second ends, the first end having an internal diameter slightly greater than the external diameter of the open top, the second and having an internal diameter slightly greater than the outside diameter of the bottom, the middle portion having an internal diameter which tapers in conformity to the tapering of the outside diameter of the body;

b. the middle portion having a front portion, a back portion and opposite first and second side portions;

c. first and second zippers formed on the first and second sides of the middle portion, respectively, each zipper extending part way up the middle portion towards the first end from the second end such that the zippers open at the second end, the first and second zippers being parallel to each other;

d. an elongated drawstring positioned in an elongated pouch formed on the first end of the tube, the elongated pouch extending along the first end adjacent the front portion and the opposite first and second portions, the elongated pouch having opposite first and second openings for the drawstring, the first opening formed at a first top corner of the middle portion where the back portion meets the first side portion and the second opening formed at a second top corner where the back portion meets the second side portion, and e. a lid cover comprising a pouch made of a flexible web material, the vouch having an opening with a lip circumscribing the opening, the lip having opposite first and second sides, an elastic band having opposite first and second ends extending across the opening, the first and of the elastic band mounted to the first side of the lip and the second end of the elastic band mounted to the second side of the lip, the pouch dimensioned to snugly fit over the lid.

2. The cover of claim 1 further comprising a vertical slot opening formed on the front portion at a central axis midway between the first and second ends and a horizontal slot opening formed on the front portion midway between the vertical slot opening and the first end.

3. A cover for a wheeled refuse container having an open top and a bottom, the open top having a outside diameter greater than an outside diameter of the bottom, a body extending between the open top and the bottom, the body having an external diameter which tapers from the open top to the bottom, a pair of wheel wells formed at the bottom, and a lid hinged at the open top, the cover comprising:

a tube made of a flexible web material, the tube having opposite open first and second ends and a middle portion extending between the first and second ends, the first and having an internal diameter slightly greater than the external diameter of the open top, the second and having an internal diameter slightly greater than the outside diameter of the bottom, the middle portion having an internal diameter which tapers in conformity to the tapering of the outside diameter of the body;

the middle portion having a front portion, a back portion and opposite first and second side portions;

first and second zippers formed on the first and second sides of the middle portion, respectively, each zipper extending part way up the middle portion towards the first end from the second end such that the zippers open at the second end, the first and second zippers being parallel to each other;

an elongated drawstring positioned in an elongated pouch formed on the first and of the tube, the elongated pouch extending along the first end adjacent the front portion and the opposite first and second portions, the elongated pouch having opposite first and second openings for the drawstring, the first opening formed at a first top corner of the middle portion where the back portion meets the first side portion and the second opening formed at a second top corner where the back portion meets the second side portion, and a vertical slot opening formed on the front portion at a central axis midway between the first and second ends and a horizontal slot opening formed on the front portion midway between the vertical slot opening and the first end.

* * * * *